US005683288A

United States Patent [19]

Kujawa

[11] Patent Number: 5,683,288

[45] Date of Patent: Nov. 4, 1997

[54] PATTERNLESS EDGER APPARATUS FOR OPHTHALMIC LENS GRINDERS

[75] Inventor: S. Kim Kujawa, Regina, Canada

[73] Assignee: Elision Technology Inc., Regina, Canada

[21] Appl. No.: 746,817

[22] Filed: Nov. 18, 1996

[51] Int. Cl.[6] ..... B24B 49/00

[52] U.S. Cl. ..... 451/9; 451/11; 451/13; 451/43; 451/240; 451/255

[58] Field of Search ..... 451/5, 9, 10, 11, 451/12, 13, 43, 240, 242, 246, 255, 256, 379, 384, 390, 398

[56] References Cited

U.S. PATENT DOCUMENTS

| | | | |
|---|---|---|---|
| 4,300,317 | 11/1981 | Croft et al. | 451/43 |
| 4,596,091 | 6/1986 | DaBoudet et al. | 451/43 |
| 4,912,880 | 4/1990 | Haddock et al. | 451/5 |
| 5,053,971 | 10/1991 | Wood et al. | 451/43 |
| 5,155,940 | 10/1992 | Suzuki | 451/5 |
| 5,161,333 | 11/1992 | Lecerf et al. | 451/43 |
| 5,398,460 | 3/1995 | Joncour | 451/43 |
| 5,605,498 | 2/1997 | Nauche | 451/240 |

*Primary Examiner*—Eileen P. Morgan
*Attorney, Agent, or Firm*—Bennett, Jones, Verchere

[57] ABSTRACT

A patternless edger apparatus is described which is mountable on mechanical pattern ophthalmic lens grinders. The apparatus has a mounting yoke adapted for mounting the apparatus in the place of the mechanical patterns to control the edge grinding of a lens blank. The mounting yoke includes a rotative spindle mount to interlock with the grinder pattern chuck and a mounting shaft releasably receivable in the spring clip bore of such lens grinders. A stored lens pattern and signalling from a grinder spindle rotational angle transducer are acted on by a microprocessor to control a motorized cam operative on the grinder pattern reaction surface to control the grinder to grind a lens blank to a perimeter shape corresponding to the stored lens pattern.

16 Claims, 3 Drawing Sheets

PATTERNLESS EDGER APPARATUS FOR OPHTHALMIC LENS GRINDERS

FIELD OF THE INVENTION

The present invention relates to apparatus for shaping the perimeter of ophthalmic lens blanks and more particularly to a patternless edger actuator apparatus mountable on patterned ophthalmic lens grinders.

BACKGROUND OF THE INVENTION

The present invention relates to an electromechanical device mountable on mechanical pattern ophthalmic lens grinding machines to replace the mechanical patterns mounted on such lens grinders.

Ophthalmic lenses are manufactured with a predefined optical correction in a suitable lens material which is fashioned into a uniform relatively large physical outside dimension called lens blanks. Lens blanks are used by optical dispensaries that vend eyeglasses for mounting in a selected frame having a unique lens perimeter. Mounting lenses in a frame requires the perimeter of the lens blank to be shaped to a shape corresponding to the unique lens perimeter of the selected frame.

To shape ophthalmic lens blanks at an optical dispensary, most dispensers have a mechanical pattern bevel edger lens grinder machine for grinding a lens blank to the final shape required to mount the lens within a particular glasses frame. In accordance with this practice, lens blanks are provided with the proper prescription to remedy the visual impairment of the person that is to wear the glasses. The selected lens blank is then mounted in the lens grinder bevel edger machine where it is cut to the shape required to fit the frames the finished lens is to be mounted on under control of a correspondingly dimensioned mechanical pattern. Grinding is typically a two step process where the lens is first rough cut to the peripheral shape required for mounting in the glasses. Thereafter, the lens is bevel edged for mounting within the frame of the glasses.

Each set of frames has a unique lens perimeter which is controlled during the grinding process by mounting a lens pattern on the grinder that is a mechanical reproduction of the physical shape of the lens to be ground. Use of such mechanical patterns requires that they be physically stored and then retrieved to match the frames that the person has selected. The optical dispensaries usually have at least one edger. There are several different makes and models of such edgers as they are manufactured by several different manufacturers. In addition, there are different edging machines used for edging various types of lens materials. One type of edger would be used for plastic lenses, another for glass lenses and another edger for polycarbonate lens materials. Each edging machine has its own associated mechanical pattern for a given frame.

As a result of the different models of edgers and the different types of lens materials, there are many problems associated with the process of grinding lenses using the bevel edgers and associated mechanical patterns including: storing and retrieving the patterns; mounting the lens blank in the edger in correct relation to the mechanical pattern to obtain correct radial displacement of the pattern for proper alignment of the optical axis of the finished lens within the frame. That is to say, the optical axis of the lens blank must be correctly displaced from the rotational asis of the grinder to permit the optical axis of the lens to align correctly with the visual axis of the wearer of the glasses when the finished lens is mounted in the frames. All lenses require correct axial alignment with respect to the mechanical pattern.

There are also mechanical variations in patterns caused by wear and chipping which tend to make it difficult to get the patterns to be an exact match to the shape of the frame. In addition, where a replacement lens is required for a frame that is brought in for repair for which there is no pre-cut mechanical pattern, a pattern must be made. All of these problems result in making lens cutting and bevelling using mechanical patterns a very time consuming, error prone process.

To alleviate the problems introduced by mechanical patterns for bevel edgers, patternless edging systems have been introduced which generally consist of a tracer system and a patternless edger grinder for grinding the lens blanks. For example, U.S. Pat. No. 4,928,439 to Ramos et al. and U.S. Pat. No. 4,912,880 to Haddock et al. describe complex electromechanical edge tracing and grinding systems that can be used to provide patternless edging. However, introduction of these patternless edger systems requires replacing the existing edger grinder machine stock with the various new grinder systems. This solution requires obsolescence of the existing grinder stock to obtain the benefits of patternless edging. As can be appreciated, such a solution requires large capital investment to obtain the benefits of patternless edging as well as premature obsolescence of existing grinder edger machines.

SUMMARY OF THE INVENTION

The present invention provides the benefits of patternless edging to the existing stock of grinders by providing a patternless edger apparatus comprising an electromechanical servo actuator assembly for mounting on existing ophthalmic edger grinders to eliminate the need for mechanical patterns and to permit patternless edging of lenses to occur.

It is a further object of the invention to provide a patternless edger apparatus which is easily installed on existing bevel edgers without requiring special skills, tools or modification of the edger machine.

A further object of the invention is to provide a patternless edger apparatus which can be easily removed from an edger machine to return the edger to a manual pattern edger in the event of patternless edger apparatus failure or the need for repair.

Another object of the invention is to provide patternless edger apparatus which is readily adaptable for mounting on any one of several of the popular brands and models of mechanical pattern edgers to permit the patternless edger apparatus to be used with different models or brands of edgers in an optical laboratory or dispensary.

In one of its aspects the invention provides a patternless edger tool for mounting on a manual pattern ophthalmic lens grinder machine comprising a mounting yoke with means for coupling said yoke to a manual pattern ophthalmic lens grinder bevel edger, a spindle rotatively disposed within said yoke for mounting on the pattern mount of said bevel edger, an actuator cam retractably extending from said yoke for contact with the pattern reaction surface of said bevel edger, a motor and means for coupling same to said actuator cam, a controller for controlling said motor in response to the rotational position of said spindle including storage means to record a stored lens pattern, means for updating said stored lens pattern whereby a lens blank mounted in said manual pattern ophthalmic lens grinder machine will be ground to a perimeter shape corresponding to said stored lens pattern.

In another aspect, the patternless edger tool is provided with a plurality of stored lens patterns and input means for selecting the pattern to be edged and means for selecting one of the stored lens patterns to permit grinding of the lens blank corresponding to the selected stored lens pattern.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to considered limiting of its scope. In the drawings.

DESCRIPTION OF THE PREFERRED EMBODIMENT

Figure 1:
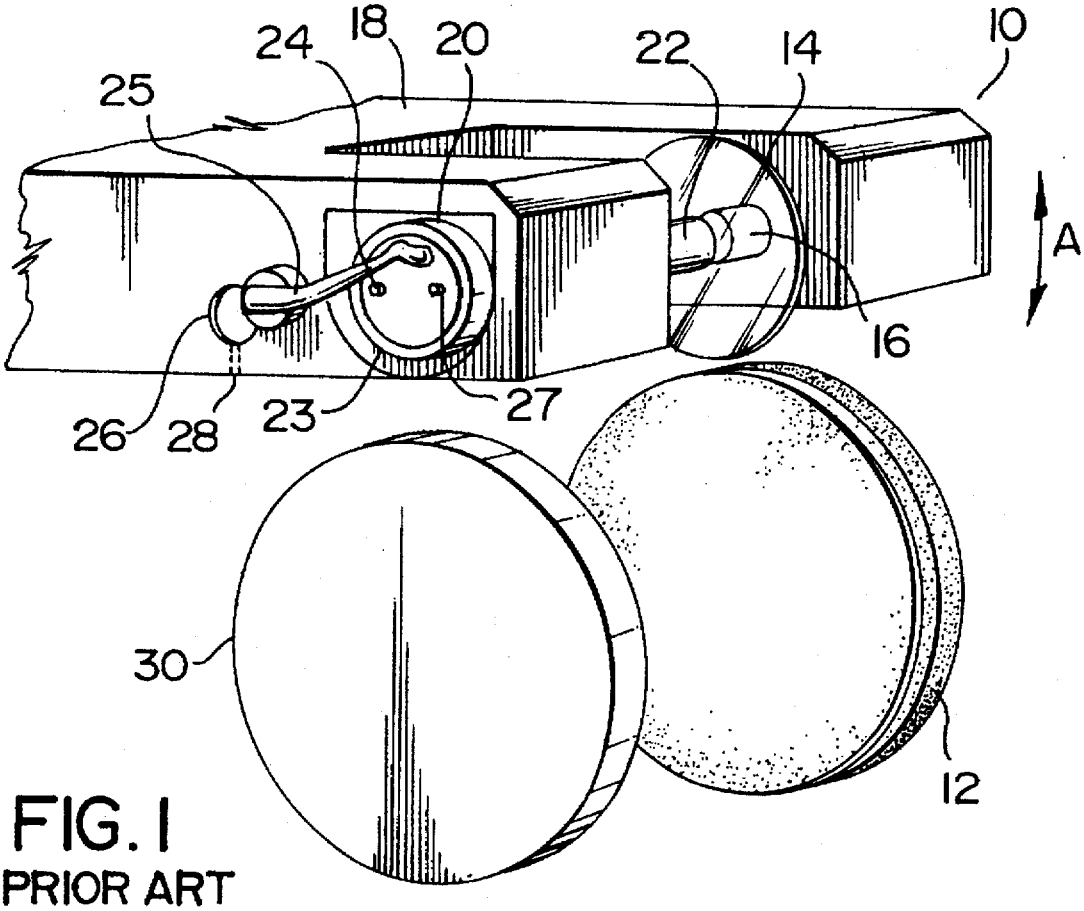
FIG. 1 PRIOR ART
FIG. 1 is a perspective schematic view of a prior art grinder.

Referring to FIG. 1 which shows a lens edger grinder 10 in schematic form. The grinder is provided with a grinding wheel 12 for grinding a lens blank 14 shown mounted in the grinder 10. Mounting of the lens blank within the grinder is achieved by engaging the lens blank 14 between two axially rotatable members forming a lens mounting chuck 16 wherein the lens is disposed to rotate coaxially with and above grinder wheel 12. The upper portion of the grinder 10 has a floating frame 18 which is pivotally movable about an axis coextensive with the axis of rotation of the grinding wheel 12 and the lens blank 14 whereby the floating frame 18 is constrained to move in a vertical arc away from and toward grinding wheel 12 as depicted by double headed arrow A.

A mechanical lens pattern 23 is mounted on the pattern mounting chuck 20. The pattern mounting chuck 20 is rotatively connected to the lens mounting chuck 16 by means of fixed shaft 22 whereby rotation of lens pattern 23 exactly corresponds with rotation of the lens blank 14. The lens pattern is oriented on pattern mounting chuck 20 by means of alignment holes 27 adapted to fit onto pattern mounting pins 24. Following mounting of the pattern on the pattern mounting pins 24 a spring clip 25, mounted in spring clip mounting bore 26, extends from the floating frame 18 to resiliently engage the lens pattern 23 on the pattern mounting chuck 20. The spring clip 25 is retained within the spring clip mounting bore 26 by means of set screw 28 whereby the spring clip is replaceably mounted on the floating frame 18.

The lens pattern 23 controls the vertical displacement of floating frame 18 from grinding wheel 12 by contacting a pattern reaction surface 30 which is commonly implemented by a contact wheel. To grind the lens blank 14 to the proper shape, fixed shaft 22 rotates through one or more revolutions causing the lens blank 14 to be shaped by the spinning grinder wheel 12 to thereby correspond with the lens pattern 23 as it rotates in contact with pattern reaction surface 30. The lens pattern 23, shaft 22 and lens blank 14 rotate as a single assembly usually by motorized control of the edger grinder or, sometimes, by having the operator manually turn an activating wheel or lever.

Figure 2:
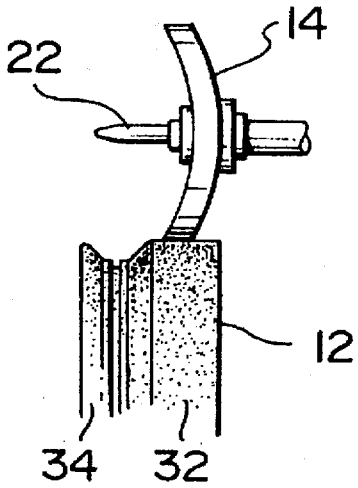
FIG. 2 is a plan view of a lens blank on a grinding wheel.

FIG. 2 shows a lens 14 in contact with a grinder wheel 12. The grinder wheels typically include a rough grinding surface 32 and a bevel grinding surface 34 to permit the lens blank to be shaped on the rough grinding surface 32 and then bevelled using the bevel grinding surface 34 to form the lens blank into shape required to fit in the selected frames.

Figure 3:
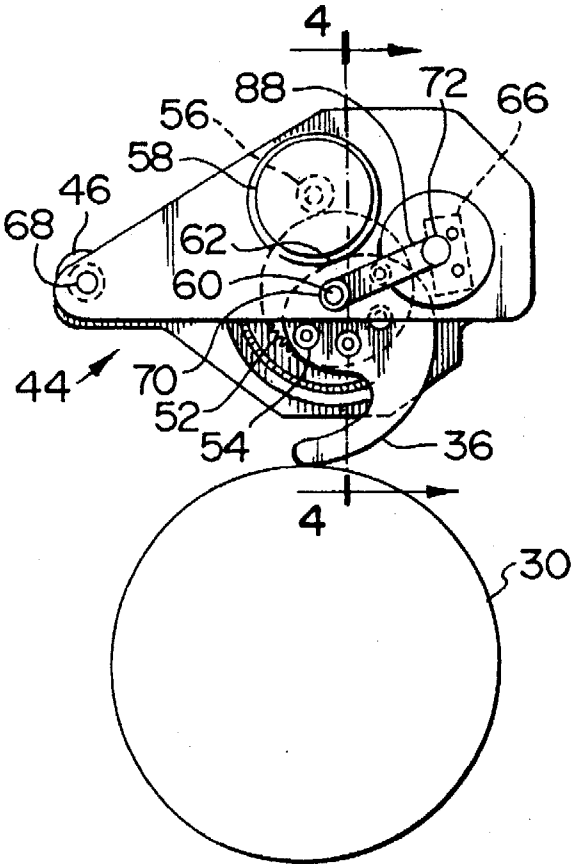
FIG. 3 is an end view of the mechanical elements of a patternless edger actuator.

FIG. 3 shows an end plan view of the preferred embodiment of the patternless edger actuator apparatus 44 in accordance with the present invention. The actuator is provided with a cam 36 that rests on the pattern reaction surface 30 to produce the vertical displacement that would be provided by a pattern in the absence of the actuator 44. Mounting the actuator 44 on an edger is obtained by providing a mounting shaft 46 which is dimensioned to be slideably received within the spring clip mounting bore 26 of the edger on which the servo 44 is to be mounted.

Cam 36 of the actuator 44 rests on the pattern reaction surface 30 of a bevel edger machine. Vertical displacement of the actuator from the pattern reaction surface 30 is effected by cam 36 which is mechanically coupled to an intermediate drive gear 52 by means of a nut and bolt arrangement 54. Intermediate drive gear 52 is driven by a pinion gear 56 which is itself rotated in a clockwise or counterclockwise direction by motor 58. The cam 36 and intermediate drive gear 52 are rotatable about spindle drive shaft 60. During operation, cam 36 may be driven to rotate to a fully extended position, as shown in FIG. 3, and to a fully closed position. In the fully closed position, cam 36 is rotated in a clockwise fashion until closed cam contact point 62 rotates into contact with the pattern reaction surface 30. In this position, the patternless edger actuator apparatus is positioned in its closest position to pattern reaction surface 30 thereby reducing the vertical displacement of the grinder floating frame 18 to which the patternless edger actuator apparatus 44 is attached.

To permit monitoring of the actual physical positioning of cam 36, the patternless edger actuator apparatus is provided with electrical feedback transducers including home switch 66 and a motor feedback encoder 64 which provides an electrical signal corresponding to the rotational position of motor 58. In the cam 36 fully opened position, as shown in FIG. 3, home switch 66 becomes activated through contact with cam 36. Home switch 66 is activated during power-up cycling of the patternless edger actuator apparatus where the power-up routine causes the cam 36 to rotate in a counterclockwise direction until home switch 66 becomes engaged thereby indicating the fully open or home position of the cam 36.

Figure 5:
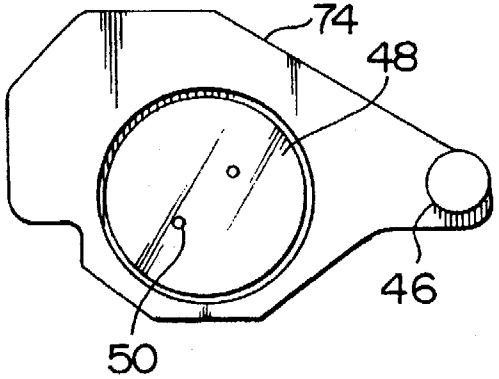
FIG. 5 is a plan view of the grinder mounting side of the patternless edger actuator apparatus.
Figure 4:
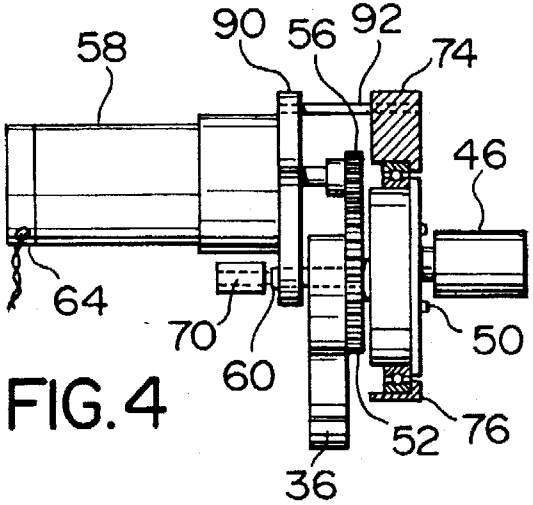
FIG. 4 is a partial cross-section along line 4—4 of FIG. 3.

FIG. 5 shows an opposite end elevation view of actuator 44 and provides a view where the mounting yoke structure of the actuator for attachment to a grinder is readily apparent. The actuator has a spindle mount 48 rotatively deposed within outside mounting plate 74. Spindle mount 48 is adapted to be mounted on a pattern mounting chuck 20 of a grinder. Each spindle mount 48 corresponds to a particular make/model of grinder and is accordingly dimensioned to fit the appropriate grinder to which the patternless edger actuator apparatus is to be mounted. Generally each grinder has a pattern mounting chuck 20 provided with pattern mounting pins 24. Spindle mount 48 has corresponding pattern spindle mounting holes 50 to slidably receive the pattern mounting pins 24. Outside mounting plate 74 has a mounting shaft 46 of suitable shape protruding therefrom at the required displacement to permit the actuator to be physically mounted on the grinder by sliding the mounting shaft 46 into the spring clip mounting bore 26 located in the floating frame 18 of the grinder 10. Mounting shaft 46 is preferably removably fastened to outside mounting plate 74 using fastening means, such as a bolt 68. Once the patternless edger actuator apparatus 44 is mounted on the floating frame 18 of the grinder, the spring clip set screw 28 is tightened to mechanically couple the patternless edger actuator apparatus to the grinder. In the mounted position, the cam 36 comes into contact with the pattern reaction surface 30 permitting the patternless edger actuator apparatus to move the floating frame 18 of the grinder upwardly and downwardly depending on the position of cam 36. As a result, the patternless edger actuator apparatus 44 mechanically replaces the pattern that was previously mounted on the edger grinder.

As the fixed shaft 22 of the grinder rotates, the spindle mount 48 of the patternless edger actuator apparatus will correspondingly rotate which rotation is transduced into an electrical signal by means of spindle pulley 70 which is fixed to the spindle drive shaft 60 and rotates with the spindle mount 48. Rotation of the spindle pulley 70 is communicated to a spindle encoder 72 by suitable means such as belt 88. The spindle encoder 72 transduces the rotational position of the lens blank 14 within the patterning mounting chuck 20 to provide a electrical signalling corresponding to the rotational position of the lens within the grinder.

Mechanically, the patternless edger actuator apparatus is provided with a mounting yoke including an outside mounting plate 74 to provide a rigid structure for mounting of the mounting shaft 46 and rotatively receiving the spindle mount 48. To provide for smooth rotation of the spindle mount 48 within the outside mounting plate 74, a spindle bearing 76 is preferably employed. An inside mounting plate 90 provides a suitable arrangement for mechanically coupling motor 58 to the actuator which also has a receiving bore for rotatively receiving spindle drive shaft 60 there through. The inside mounting plate is rigidly connected to the outside mounting plate 74 by suitable means such as one, or preferably more, bolts 92.

Actuator 44 is provided with a memory to contain a digital pattern image to be ground. There may be a large number of pre-stored digital pattern images contained within the actuator memory, or a pattern may be obtained from a tracer/computer system (not shown). The pattern to be ground is selected by the user using a suitable keypad to receive input selections. Also provided is display for output to permit the user to interact with the actuator 44 to select the pattern to be edged. The keypad input is also used to specify actual offset information or select actual offset information to correctly axially align the lens pattern to be ground with the optical axial center of the lens. Thus a single digitally stored copy of the pattern may be readily rotated and off-set to correctly align the selected pattern profile with a lens blank mounted in the grinder. Once the shape and off-set information are provided to the actuator, grinding can begin. During grinding, the actuator senses the radial position of the lens 14 by means of the spindle encoder 72 which information is used to vertically position the lens blank appropriately over the grinding wheel 12 by means of the cam 36 which operates against pattern reaction surface 30. The position of cam 36 is controlled to correspond to the selected pattern contained in memory by signalling provided to the motor 58. In this fashion, the action of an original mechanical pattern on the edger is reproduced by means of the herein described embodiment of a patternless edger actuator. While grinding, the edging machine 10 is commonly operated to cause the lens 14 to go through at least two or more complete revolutions to ensure that the correct exterior perimeter dimensioning has been applied to the lens blank. The grinding on the rough wheel 32 operates to remove most of the excess lens material from the lens blank, thereafter, the lens is positioned over the bevelled grinder surface 34 which smooths the finished edge and puts a bevel around the perimeter of the lens that facilitates mounting the lens in the eyeglass frame. This cycling function is performed by the edger itself based on sensors (not shown) that the edger has within the frame 18 as it moves with respect to the grinder wheel 12. The design of the patternless edger actuator apparatus herein is made in such a way as to exactly mimic the interaction of a mechanical pattern with the edger. Accordingly, the performance of the edger 10 and its lens grinding cycling function is not affected by mounting of the patternless edger actuator apparatus 44 described herein.

The spindle drive shaft 60 performs several functions. It is the load bearing device that attaches the inventive apparatus to the edger. The spindle drive shaft 60 extends from the spindle mount 48 which is rotatively contained within the outside mounting bracket 74 by means of a spindle bearing 76 that may be glued to the spindle mount 48 and the outside mounting plate 74 using a bearing adhesive that is well known in the mechanical arts.

In the design of the preferred embodiment of a patternless edger actuator apparatus, as described herein, a system design which is heavy duty yet is capable of precision positioning is needed. The apparatus must lift a weight in the order of 10 kg, being the frame 18 of the grinder 10 and yet position this mass with a positional accuracy in the range of 0.025 mm all while performing with velocity and acceleration outputs that permit all shape of lens perimeters to be formed at the grinder lens rotational rate of the lens grinding machine. The patternless edger device must be provided at a minimum of size and cost. By using a spiral cam 36 and reduction gear assembly as the described preferred embodiment herein, it is possible to configure the cam 36 to provide the required dynamic range and positional accuracy as well as the acceleration and velocity constraints that arise when a lens is being ground during operation of the apparatus.

Figure 6:
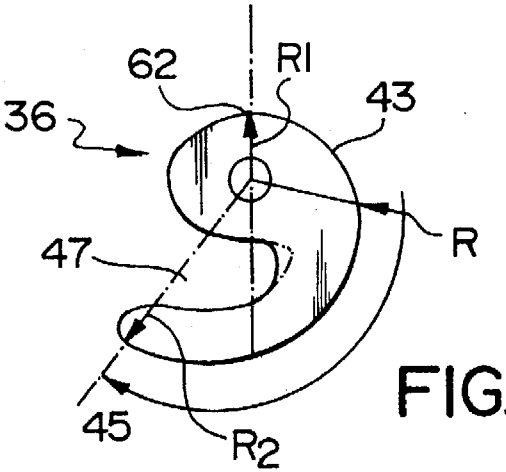
FIG. 6 is a side elevation view of an actuator cam.

FIG. 6 is a side elevation view of an actuator cam 36 in accordance with the preferred embodiment of the invention. Cam 36 is provided with an actuator contact surface 43 that contacts with pattern reaction surface 30 of the bevel edger over a wide contact angle 45 as depicted by the curved arrow having numeral 45 proximate to the arrow head. The contact angle 45 may be as large as 200 degrees of rotation, with provision for interoperation with other gearing and mechanical parts being made by providing a throat area 47 in the cam. Contact surface 43 increases in radial displacement uniformly as cam 36 is rotated from closed position radius R1 to open position radius R2 whereby there is a constant linear relationship between the contact angle 45 and the radius R.

Figure 7:
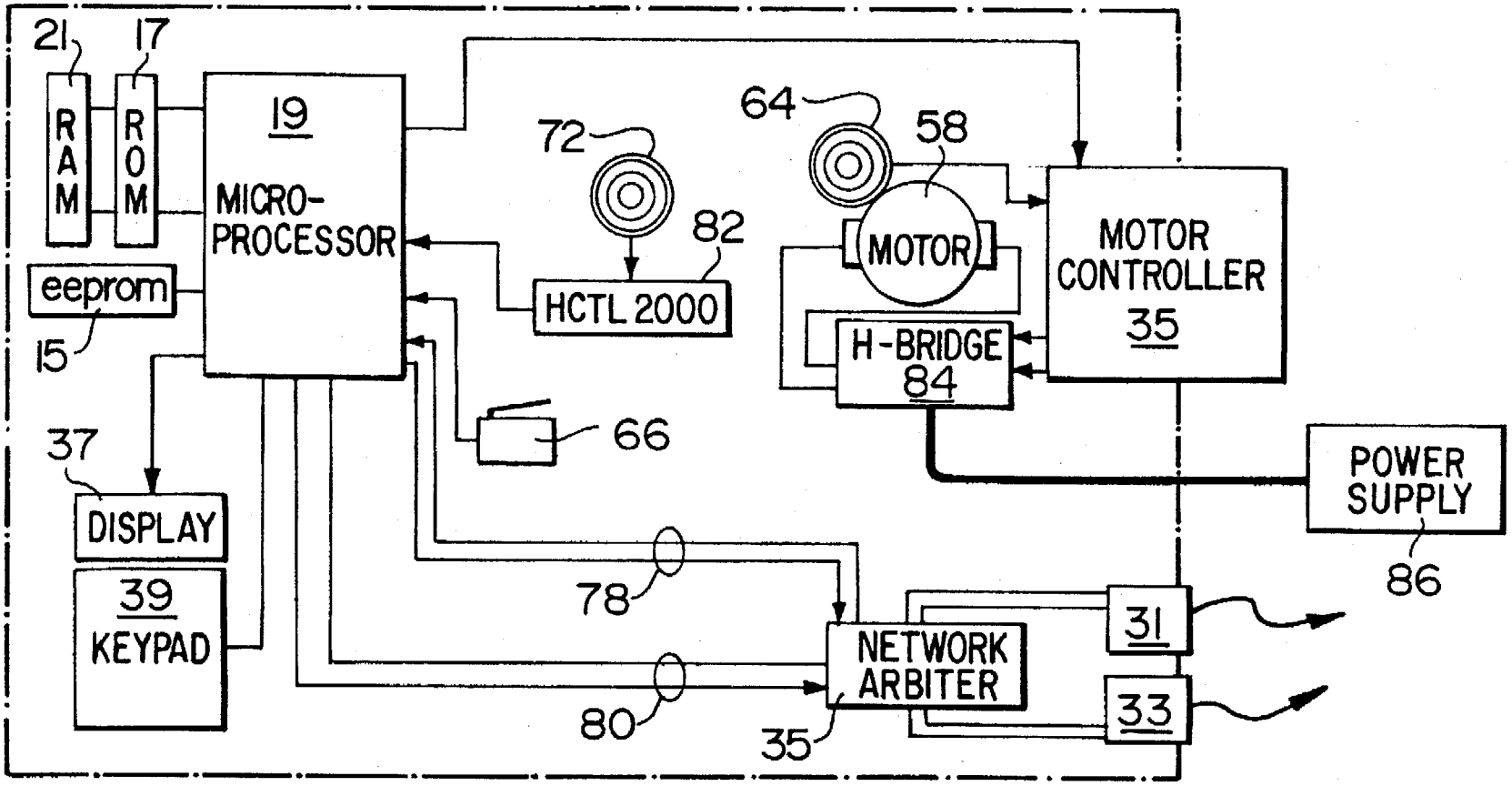
FIG. 7 is a functional block diagram of the electrical system of the patternless edger actuator.

FIG. 7 shows a functional block diagram of the electrical system of the preferred embodiment of the patternless edger actuator. The actuator is controlled by a microprocessor 19 that has a memory associated therewith including random access memory (RAM) 21, read-only memory (ROM) 17 and electrically erasable, programmable, read-only memory (EEPROM) 15. In operation RAM 21 contains a representation of the pattern to be edged while ROM 17 and EEPROM 15 are used to contain the programs for operation of the microprocessor including protocols for exchanging information over the network connections 31 and 33. Communication over the network essentially involves exchange of pattern information with a tracer or a storage system such as a computer that contains pattern information. Communications may be effected using RS-232 protocol. A network arbiter 35 is provided to permit multiple patternless edger actuator apparatus to be connected to the same RS-232 communications link thereby permitting many edger bevellers to operate on the same communications network.

A keypad 39 is provided to allow the user to input selections which are communicated to the microprocessor 19. Available options and required inputs are indicated to the user on display 37. Display 37 provides visually perceptible output including alpha numeric text or other suitable symbols or graphic images to be displayed under control by microprocessor 19. Keypad 39 is used to select the pattern outline required. As the pattern is a digital representation of the desired shape, it is not subject to the wear and chipping problems of a mechanical pattern. Keypad 39 is also used to provide the axial offset needed to correctly displace the pattern outline from the rotational axis of the lens (the lens blank is mounted in the lens chuck to align the optical axis of the lens with the rotational axis of the grinder). In this manner the axial and radial alignment of the pattern to the lens blank may be easily and readily provided.

The microprocessor 19, which can be any suitable microcontroller as are available for real time process control functions, communicates with the network arbiter 35 using a control signalling data path 78 and the pattern data received over the network or user selections to be transmitted over the network are communicated to the network via network arbiter 35 in communication with the microprocessor 19 over a datapath 80 provided therebetween. Home switch 66 is connected to the microprocessor to provide an input signalling when the cam 36 is in a fully extended position as described earlier. Rotational position of the spindle 60 is communicated to the microprocessor from spindle encoder 72 through an encoder resolver 82.

Motor 58 is driven by an H-bridge 84 under a modulation scheme which preferably reduces power dissipation and resulting heat production and is provided to it by motor controller 35. The preferable modulation scheme includes pulse width modulation to minimize the power dissipation requirements of the motor control circuit. The motor controller 35 and H-Bridge 84 can be semi-conductor devices such as those manufactured by National Semicondutor, for example the LM929 motor controller using programmable proportional, integral, derivative (PID) parameters in the controller path.

The microprocessor 19 executes its program from the read-only memory 17 upon application of power to the system from an external DC power supply 86. On power-up self test, microprocessor 19 will ready the system for operation by calibrating the spindle feedback encoder 72 as follows: The motor 58 will be activated and cause the cam 36 to rotate counterclockwise until home switch 66 is activated. Microprocessor 19 then stops the motor 58 and defines this absolute position, or home position, as position 0 which is recorded by providing the proper reset instruction to motor controller 35 which corresponds to the fully extended position of the cam.

It will be apparent that many changes including mechanical equivalents and substitutions may be made to the illustrative embodiments, while falling within the scope of the invention as defined by the claims appended hereto.

I claim:

1. A patternless edger tool for mounting on a manual pattern ophthalmic lens grinder machine comprising:

a mounting yoke with means for coupling said yoke to a manual pattern ophthalmic lens grinder bevel edger;

a spindle rotatively disposed within said yoke for mounting on a pattern mount of said bevel edger;

an actuator cam retractably extending from said yoke for contact with a pattern reaction surface of said bevel edger;

a motor and means for coupling same to said actuator cam a controller for controlling said motor in response to the rotational position of said spindle including storage means to record a stored lens pattern;

means for updating said stored lens pattern;

whereby a lens blank mounted in said manual pattern ophthalmic lens grinder machine will be ground to a perimeter shape corresponding to said stored lens pattern.

2. Apparatus as claimed in claim 1 including input means for manipulating said stored lens pattern by any one of:

providing an axial displacement; or providing a radial orientation;

whereby the perimeter shape ground on said lens blank corresponding to said stored lens pattern will be axially displaced and oriented with respect to the optical axis of said lens.

3. Apparatus as claimed in claim 1 wherein said coupling means comprises a mounting shaft slidably receivable in said lens grinder bevel edger.

4. Apparatus as claimed in claim 3 wherein said mounting shaft is slidably received in a floating frame of said lens grinder bevel edger.

5. Apparatus as claimed in claim 1 wherein said actuator cam comprises a disk of increasing radial dimension over a predefined radial arc.

6. Apparatus as claimed in claim 5 wherein said radial arc exceeds 200 degrees of rotation.

7. Apparatus as claimed in claim 6 wherein said actuator cam includes a radially inwardly confined gear throat to maximize said predefined radial arc.

8. Apparatus as claimed in claim 5 wherein said actuator cam provides a constant linear increase in radial dimension for each corresponding rotation throughout the range of said predefined radial arc.

9. A patternless edger tool for mounting on a manual pattern ophthalmic lens grinder machine comprising:

a mounting yoke with means for coupling said yoke to a manual pattern ophthalmic lens grinder bevel edger;

a spindle rotatively disposed within said yoke for mounting on a pattern mount of said bevel edger;

an actuator cam retractably extending from said yoke for contact with a pattern reaction surface of said bevel edger;

a motor and means for coupling same to said actuator cam a controller for controlling said motor in response to the rotational position of said spindle including storage means to record a plurality of stored lens patterns;

means for selecting one stored lens pattern from said plurality of stored lens patterns;

whereby a lens blank mounted in said manual pattern ophthalmic lens grinder machine will be ground to a perimeter shape corresponding to said selected lens pattern.

10. Apparatus as claimed in claim 9 including input means for manipulating said selected lens pattern by any one of:

providing an axial displacement; or providing a radial orientation;

whereby the perimeter shape ground on said lens blank will be axially displaced and oriented with respect to the optical axis of said lens blank.

11. Apparatus as claimed in claim 9 wherein said coupling means comprises a mounting shaft slidably receivable in said lens grinder bevel edger.

12. Apparatus as claimed in claim 11 wherein said mounting shaft is slidably received in the floating frame of said lens grinder bevel edger.

13. Apparatus as claimed in claim 9 wherein said actuator cam comprises a disk of increasing radial dimension over a predefined radial arc.

14. Apparatus as claimed in claim 13 wherein said radial arc exceeds 200 degrees of rotation.

15. Apparatus as claimed in claim 14 wherein said actuator cam includes a radially inwardly confined gear throat to maximize said predefined radial arc.

16. Apparatus as claimed in claim 13 wherein said actuator cam provides a constant linear increase in radial dimension for each corresponding rotation throughout the range of said predefined radial arc.

* * * * *